US005716308A

United States Patent [19]

Lee

[11] Patent Number: 5,716,308

[45] Date of Patent: Feb. 10, 1998

[54] BODY EXERCISER

[76] Inventor: Sunny Lee, No. 257-8, Chung-Cheng Rd., Tsao-Tun Chen, Nan-Tou Hsien, Taiwan

[21] Appl. No.: 820,014

[22] Filed: Mar. 18, 1997

[51] Int. Cl.[6] ..... A63B 21/055

[52] U.S. Cl. ..... 482/130; 482/138; 482/140

[58] Field of Search ..... 482/100, 112, 482/130, 133, 137, 138, 140

[56] References Cited

U.S. PATENT DOCUMENTS

| | | | |
|---|---|---|---|
| 5,540,533 | 7/1996 | Olson et al. | 482/138 X |
| 5,545,114 | 8/1996 | Guoich | 482/140 |
| 5,549,530 | 8/1996 | Fulks | 482/138 X |

*Primary Examiner*—Richard J. Apley

*Assistant Examiner*—John Mulcahy

*Attorney, Agent, or Firm*—Fish & Richardson P.C.

[57] ABSTRACT

A body exerciser includes a base, a backrest member, a pair of handle members, an angled cantilever, a footrest unit and two elastic cords. The base has a seat member and two pairs of guide rings mounted to the top and bottom portions of the base. The backrest member is connected pivotably to the base adjacent to the seat member. A U-shaped connecting member is fixed to the backrest member. The handle members are connected pivotally to the U-shaped connecting member. The cantilever has a lower section which is connected pivotably to the base and an upper section which is connected to the footrest unit. The elastic cords extend through the guide rings on the base and interconnect the U-shaped connecting member and the footrest unit. The exerciser may be used to perform sit-ups, crunches, leg extensions, curls and pectoral fly exercises.

3 Claims, 8 Drawing Sheets

BODY EXERCISER

BACKGROUND OF THE INVENTION

1. Field of the Invention

This invention relates to a body exerciser, more particularly to a body exerciser which has a simple structure and which can be used to preform a number of different exercises.

2. Description of the Related Art

Referring to FIG. 1, a conventional body exerciser is shown to comprise a base frame 1 having a seat member 2 mounted thereto. The front end of the seat member 2 has a pivotable footrest unit 3. A overhanging bar 4 is connected pivotably to the base frame 1 above the seat member 2. The front end of the overhanging rod 4 has a set of cantilevers 5 connected pivotably thereto for performing a chest exercise. A plurality of pulleys 6 are mounted to and under the overhanging rod 4. A rope 7 passes over the pulleys 6 and has a first end connected to a weight unit 8 and a second end which is connected to the front end of the overhanging rod 4. In addition, two ropes *7a*, *7b* interconnect the bottom of the base frame 1 and the footrest unit 3, and a pulley *6a* and the cantilevers 5. With the aforementioned structure, the user can exercise his chest by means of pushing the cantilevers 5 forward, exercise his arms by lifting the cantilevers 5, and exercise his legs by lifting the footrest unit 3 against the force of the weight unit 8. However, because the conventional body exerciser has a plurality of pulleys 6, *6a* and a bulky weight unit 8, the structure of the conventional body exerciser is both complicated and bulky.

SUMMARY OF THE INVENTION

It is therefore a main object of the present invention to provide a body exerciser which has a simple and compact structure.

According to the present invention, the body exerciser comprise:

a base having a seat member mounted to a top portion thereof, and two pairs of front and rear guide rings connected to a bottom portion thereof adjacent to front and rear end portions thereof respectively;

a backrest member connected pivotably to the top portion of the base so that the backrest member can rest on the top portion of the base adjacent to and flush with the seat member;

a U-shaped connecting member having a base portion and two upright arm portions that extend upwardly from the base portion, the base portion being fixed to a bottom face of the backrest member, the arm portions being located on opposite sides of the backrest member;

a pair of handle members, each having a vertical connecting rod with upper and lower ends and a horizontal grip rod which is connected to the upper end of the vertical connecting rod at an end of the grip rod, the upper end of each of the vertical connecting rods being connected pivotably to a distal end of a respective one of the arm portions of the U-shaped connecting member in such a manner that the grip rods are located on opposite sides of the backrest member, the vertical connecting rod of each of the handle members having two positioning rings connected respectively adjacent to the upper and lower ends thereof;

an angled cantilever having a lower section and an upper section which is connected the lower section to form an angle therebetween, a juncture of the lower and upper sections being connected pivotably to the front end portion of the base, the upper section having a plurality of threaded holes formed along a length thereof;

a footrest unit having a link rod, a sleeve member and a support rod which are connected generally perpendicularly and respectively to two ends of the link rod, the sleeve member being sleeved slidably onto the upper section of the angled cantilever and having a hole and a locking bolt which extends through the hole of the sleeve member in order to engage one of the threaded holes of the cantilever, thereby locking selectively the sleeve member on the cantilever, the sleeve member having two leg-resting members extending perpendicularly from opposite sides thereof, the support rod having upper and lower ends, each of the upper and lower ends of the support rod having a pair of positioning members extending perpendicularly from opposite sides thereof; and two elastic cords, each having a first end connected to the support rod of the footrest unit and a second end connected to a pull member, each of the elastic cords extending through a respective one of the front guide rings, a respective one of rear guide rings, and the positioning rings of a respective one of the vertical connecting rods.

BRIEF DESCRIPTION OF THE DRAWINGS

Other features and advantages of this invention will become apparent in the following detailed description of the preferred embodiment of this invention with reference to the accompanying drawings, in which.

DETAILED DESCRIPTION OF THE PREFERRED EMBODIMENT

Figure 1:
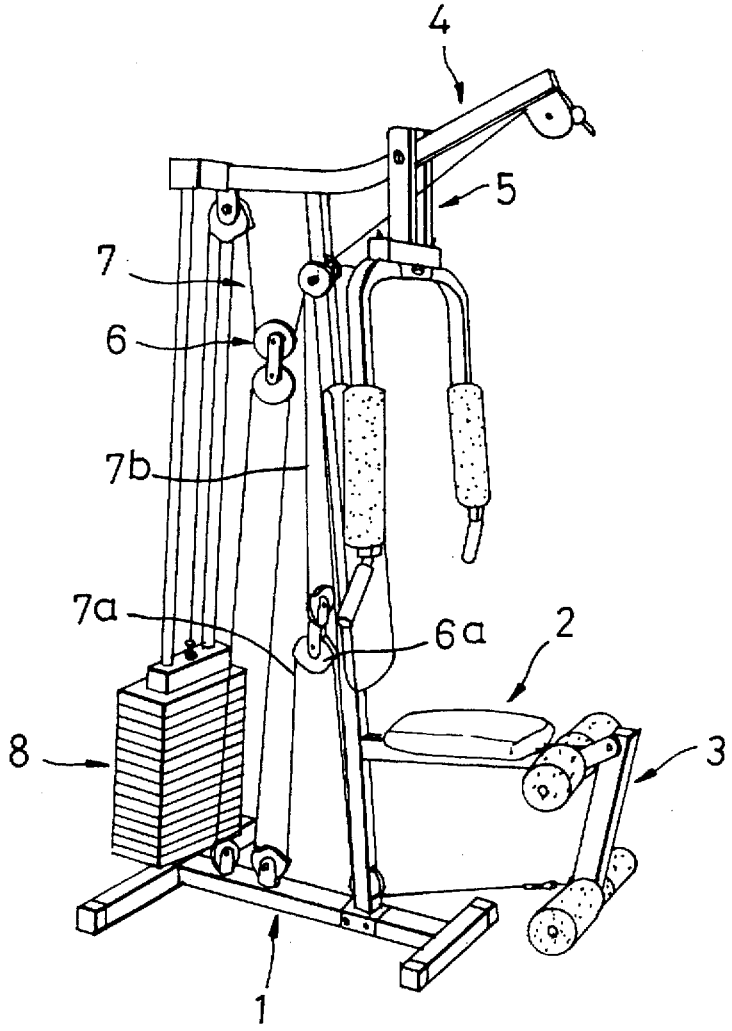
FIG. 1 PRIOR ART
FIG. 1 is a perspective view of a conventional body exerciser.
Figure 2:
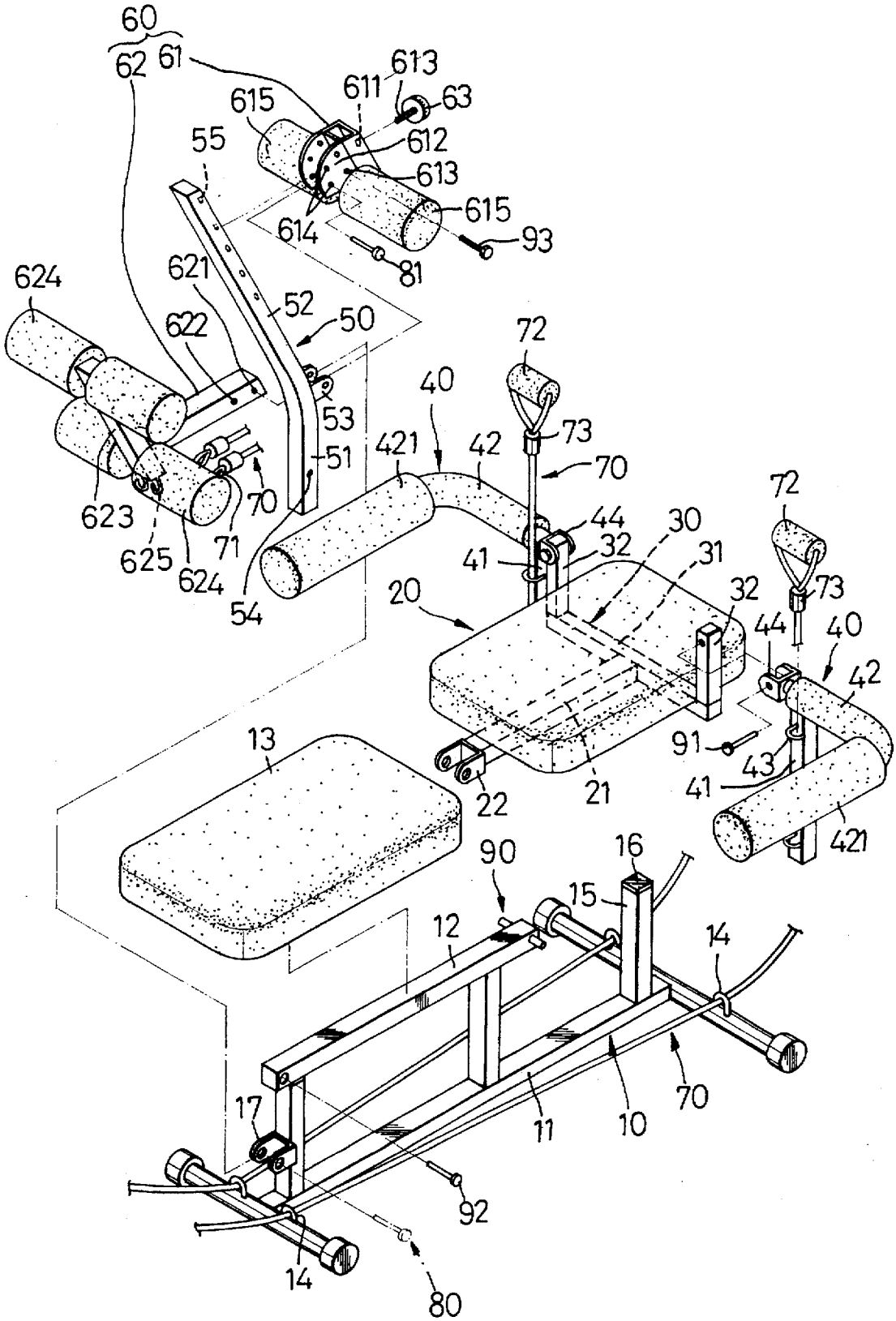
FIG. 2 is an exploded view of a preferred embodiment of a body exerciser according to the present invention.
Figure 3:
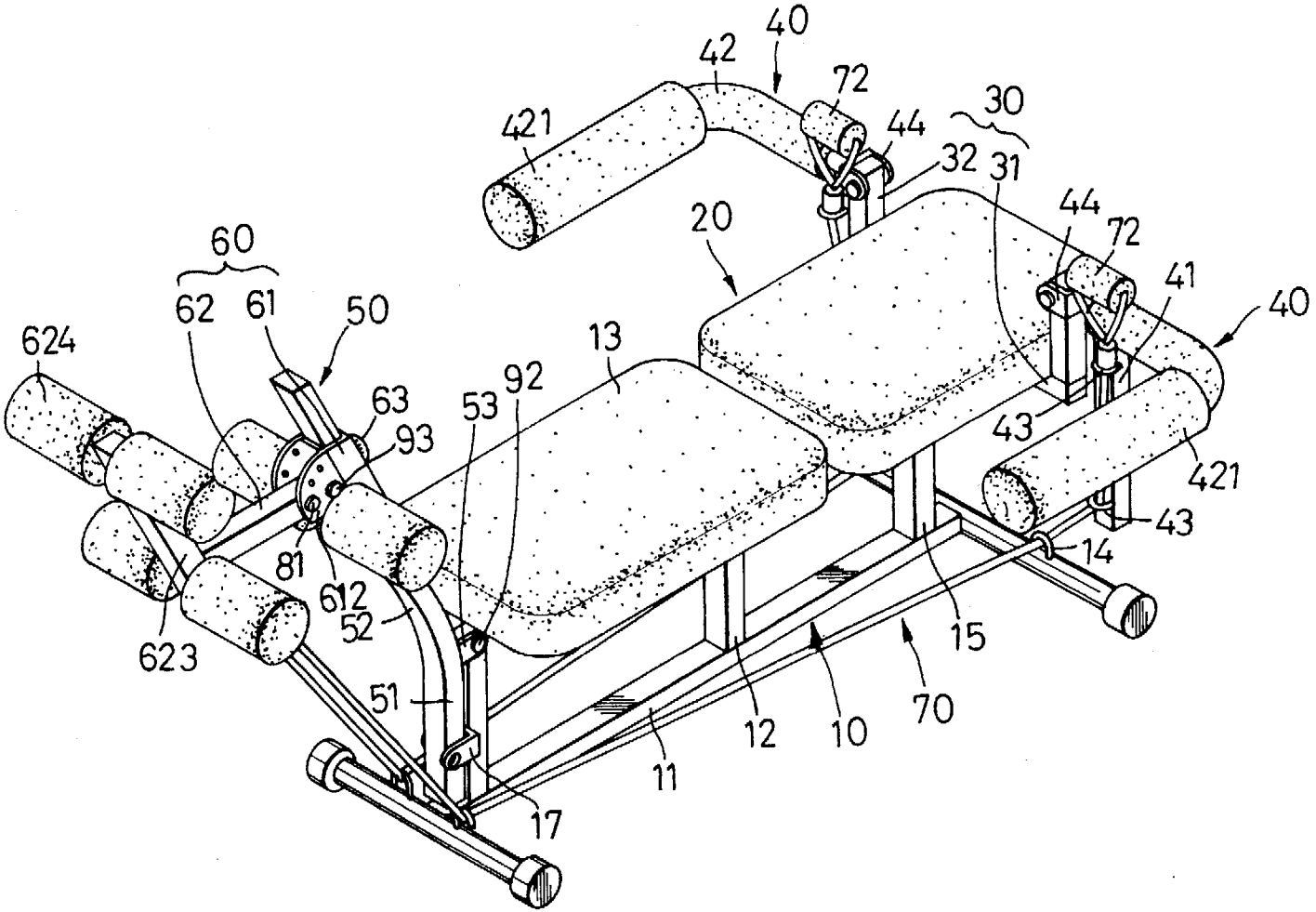
FIG. 3 is a perspective view of the preferred embodiment of the body exerciser according to the present invention.

Referring to FIGS. 2 and 3, the preferred embodiment of a body exerciser according to the present invention is shown to comprise a base 10, a backrest member 20, a U-shaped connecting member 30, a pair of handle members 40, an angled cantilever 50, a footrest unit 60 and two elastic cords 70.

The base 10 has a generally I-shaped base frame 11 and an inverted U-shaped frame 12 connected to the top face of the base frame 11. A seat member 13 is mounted to a top portion of the inverted U-shaped frame 12. Two pairs of front and rear guide rings 14 are connected to a bottom portion of the base frame 11 adjacent to front and rear end portions of the base frame 11, respectively. The base frame 11 further has an upright post 15 adjacent to the rear end portion thereof. The upper end of the upright post 15 has a rubber piece 16 fixed thereon. A pivot seat 17 is formed on the inverted U-shaped frame 12 adjacent to the front end portion of the base frame 11. The pivot seat 17 has a pin member 80 extending therethrough. The inverted U-shaped frame 12 has a transverse rod 90 formed on the top portion thereof near the upright post 15.

The backrest member 20 has a support rod 21 fixed to the bottom face thereof. One end of the support rod 21 has a pivot seat 22 which is connected pivotably to the transverse pin 90 of the inverted U-shaped frame 12 so that the backrest member 20 can rest on the rubber piece 16 on the upright post 15 so as to be flush with the seat member 13.

The U-shaped connecting member 30 has a base portion 31 and two upright arm portions 32 extending upwardly from the base portion 31. The base portion 31 is welded to a bottom face of the backrest member 20. The arm portions 32 are located on opposite sides of the backrest member 20.

Each of the handle members 40 has a vertical connecting rod 41 with upper and lower ends and an L-shaped horizontal grip rod 42 which is connected to the upper end of the vertical connecting rod 41 at an end of grip rod 42. Each of the grip rods 42 has a grip portion 421 which is provided with foam member. The upper end of each of the vertical connecting rods 41 has a pivot seat 41 which is connected pivotably to a distal end of a respective one of the arm portions 32 of the U-shaped connecting member 30 by means of a pivot shaft 91 received in a pivot seat 44 in such a manner that the grip rods 42 are located on opposite sides of the backrest member 20. The vertical connecting rod 41 of each of the handle members 40 has two positioning rings 43 connected respectively adjacent to the upper and lower ends thereof.

The cantilever 50 has a lower section 51 and an upper section 52 which is connected to the lower section 51 to form an angle therebetween. The juncture of the lower and upper sections 51, 52 has a pivot seat 53 connected pivotably to the inverted U-shaped frame 12 adjacent to the front end portion of the base 10 by means of a pin member 92. The lower section 51 of the cantilever 50 has a through hole 54 through which the pin member 80 extends in order to position the cantilever 50 on the base 10. The upper section 52 of the cantilever 50 has a plurality of threaded holes 55 formed along the length thereof.

The footrest unit 60 has a link rod 62, a sleeve member 61 and a support rod 623 which are connected generally perpendicularly and respectively to two ends of the link rod 62. The sleeve member 61 is sleeved slidably onto the upper section 52 of the angled cantilever 50 and has a hole 611 and a locking bolt 63 which extends through the hole 611 in order to engage one of the threaded holes 55 of the cantilever 50, thereby locking selectively the sleeve member 61 on the cantilever 50. The sleeve member 61 has two spaced, opposed lugs 612 formed at an upper end thereof. The lugs 612 have a pair of aligned through holes 613, a pin member 93 extending through the through holes 613, a number of pairs of angularly spaced, aligned holes 614 and a locking pin 81 extending through one of the pairs of aligned holes 614. One end of the link rod 62 has a pivot hole 621 through which the pin member 93 extends for pivot connection between the lugs 612. The link rod 62 further has a positioning hole 622 through which the locking pin 81 extends in order to position the link rod 62 relative to the sleeve member 61 at a predetermined angle. The sleeve member 61 has two leg-resting members 615 extending perpendicularly from opposite sides thereof. The support rod 623 has upper and lower ends which have a respective pair of positioning members 624 extending perpendicularly from opposite sides thereof. The lower end of the support rod 623 has a pair of hooks 625 connected thereto.

Each of the elastic cords 70 has a first end 71 which is formed as a ring and which is connected to a respective one of the hooks 625 of the support rod 623 of the footrest unit 60 and a second end 73 which is connected to a pull member 72. Each of the elastic cords 70 extends through a respective one of the front guide rings 14, a respective one of rear guide rings 14, and the positioning rings 43 of a respective one of the vertical connecting rods 41. The second ends 73 of the elastic cords 70 may be retained detachably in the positioning rings 43, as best illustrated in FIG. 3.

The operations and advantages of the body exerciser according to the present invention will be explained hereinbelow.

Figure 4:
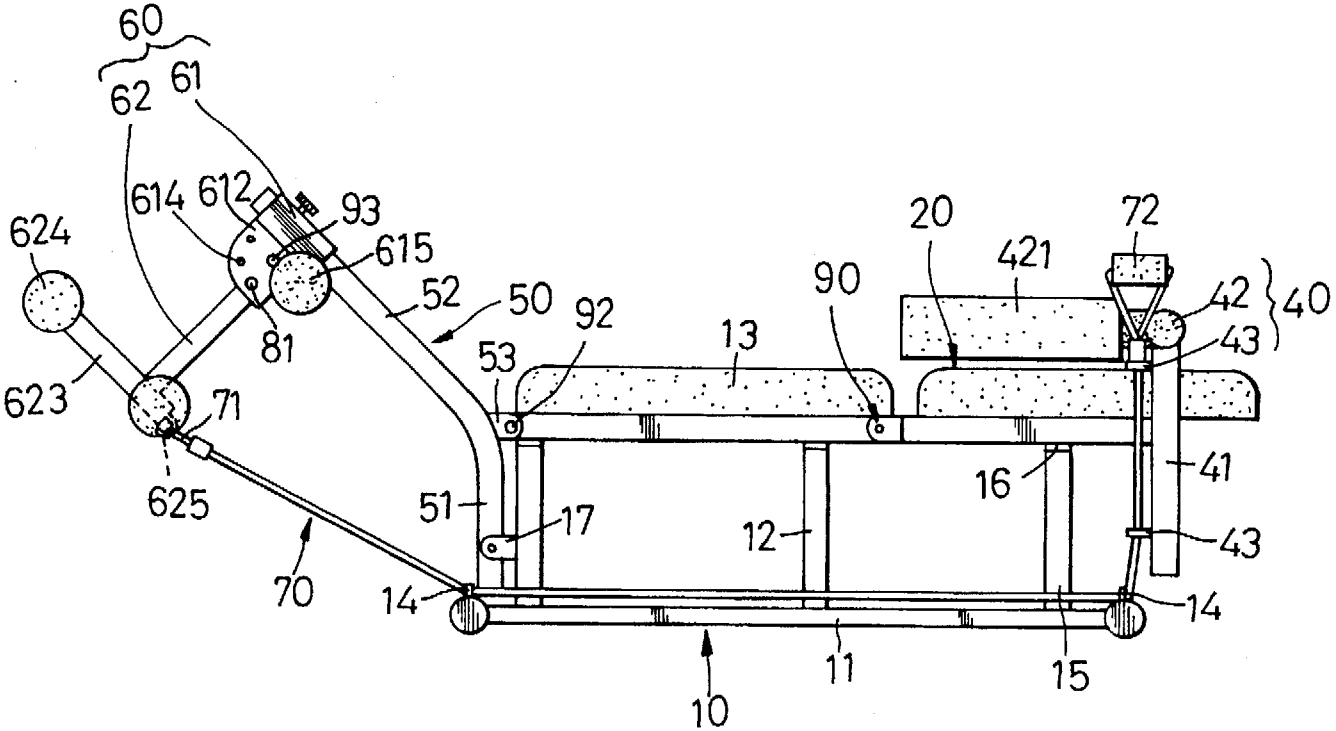
FIG. 4 is a side view of the preferred embodiment.

FIGS. 4 illustrates the body exerciser when not in use. At this time, the connecting rods 41 are parallel to the arm portions 32 by virtue of the tension force of the elastic cords 70, and the lower section 51 of the cantilever 50 abuts against the pivot seat 17 but does not engage the pin member 80, thereby allowing the rotation of the cantilever 50 relative to the inverted U-shaped frame 12. The footrest unit 60 is positioned on the upper section 52 of the cantilever 50.

Figure 5:
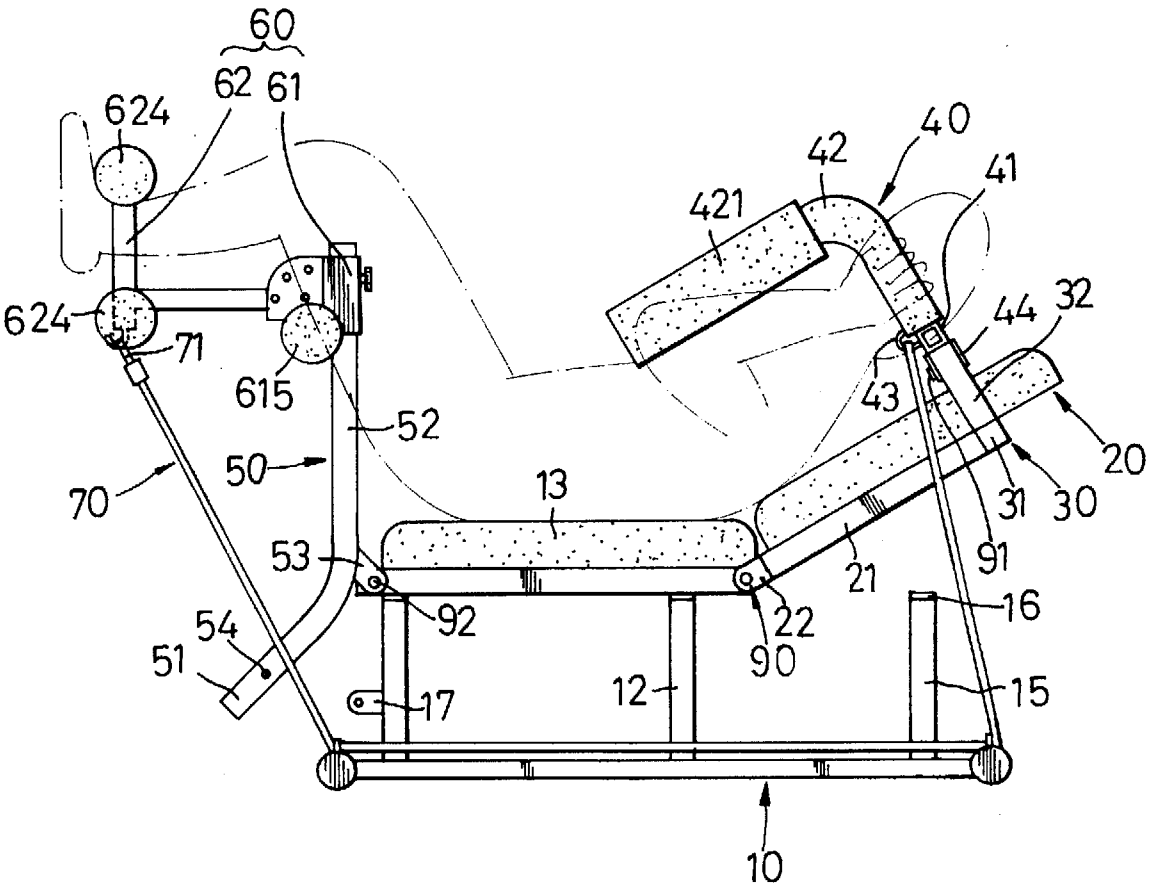
FIG. 5 is a schematic view illustrating how the body exerciser is used with the user's body being bent.

Referring to FIG. 5, the user lies down on the seat member 13 and the backrest member 20 and grips the grip rods 42 of the handle members 40 with his elbows abutting against the lower sides of the grip portions 421. The user's feet are hooked on the positioning members 624 with his thighs resting on the leg-resting members 615 of the footrest unit 60. When the user moves his arms upwardly and inwardly against the tension force of the elastic cords 70, the handle members 40 are rotated about the pivot shaft 91 by about 90 degrees to a position where the connecting rods 41 are generally perpendicular to the arm portions 32 and the grip rods 42 on opposite sides of the user's head. In this way, the user can exercise his arms and chest. Meanwhile, the user lifts his legs in order to permit rotation of the footrest unit 60 relative to the inverted U-shaped frame 12 about the pin member 92 against the tension force of the elastic cords 70, thereby exercising the user's legs.

Of course, the user may exercise either his chest and arms or his legs by moving his arms and legs individually.

Figure 6:
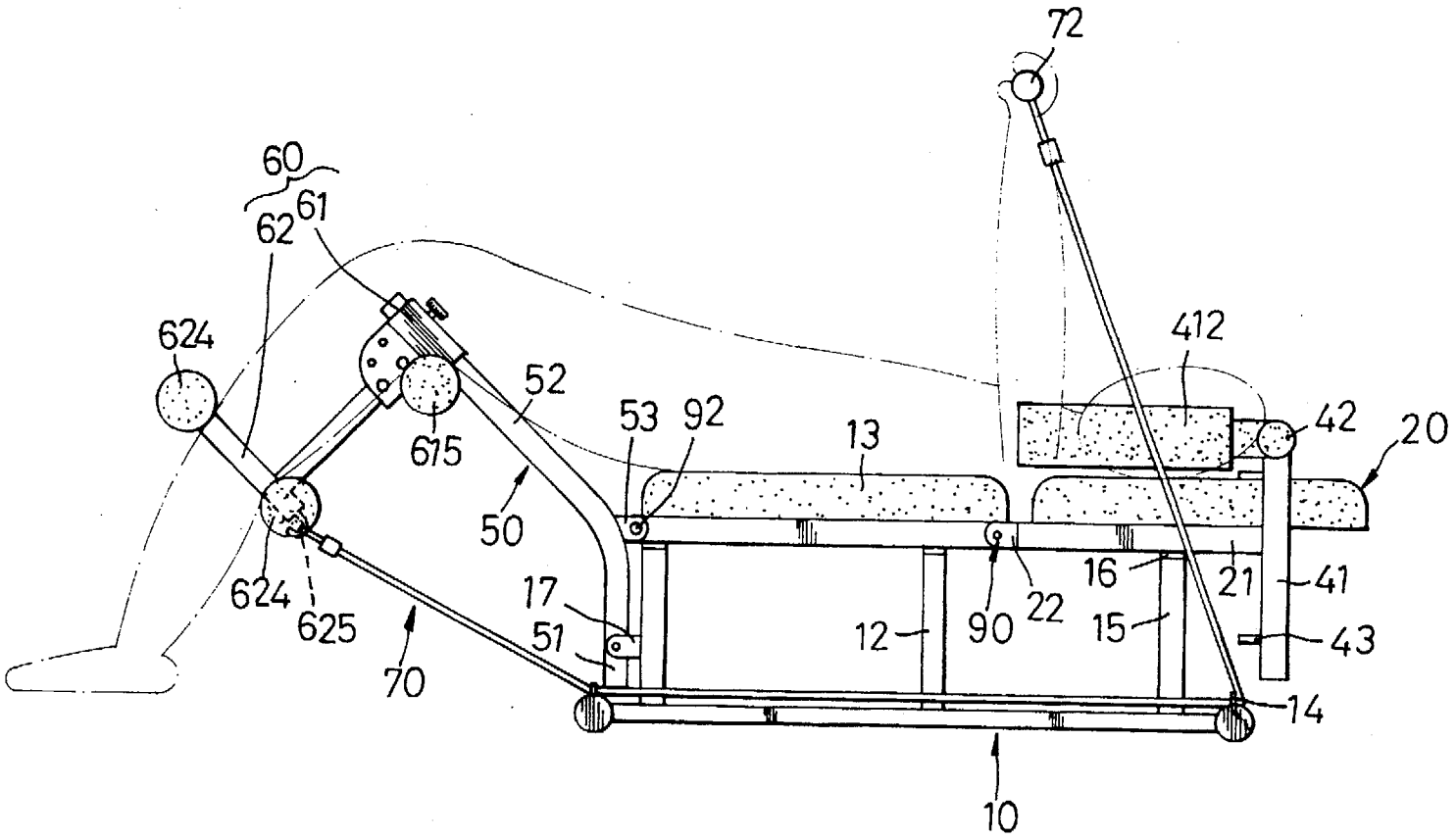
FIG. 6 is a schematic view illustrating how the body exerciser is used for weight-lifting purposes.

Referring to FIG. 6, the user lies down on the seat member 13 and the backrest member 20, grips the pull members 72 and pulls the same upwardly against the spring force of the elastic cords 70 in order to exercise his arms.

Figure 7:
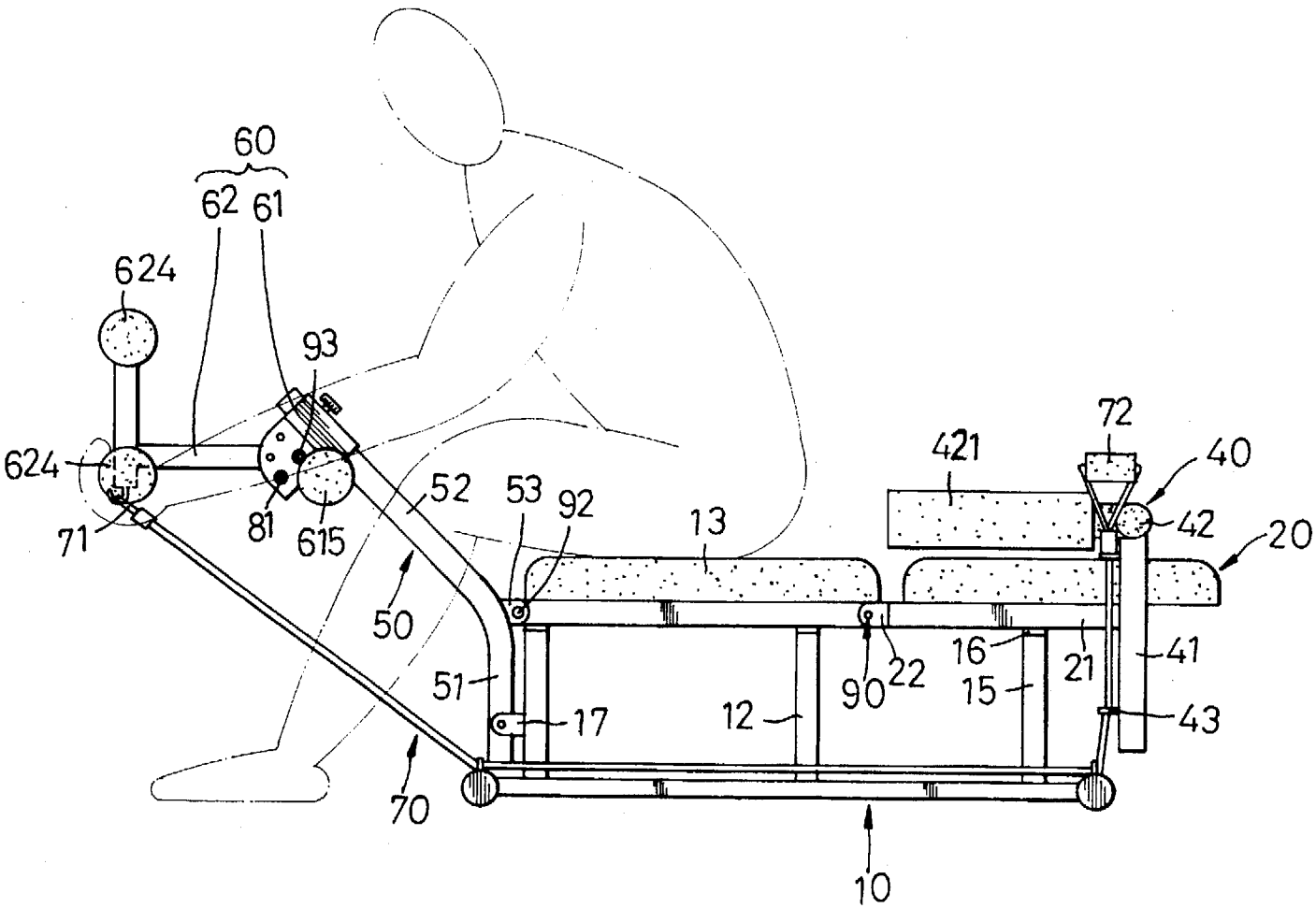
FIG. 7 is a schematic view illustrating how the body exerciser is used to exercise the user's arms.

Referring to FIG. 7, the locking pin 81 is extended through one pair of the aligned holes 614 of the sleeve member 61 and the positioning hole 622 of the link rod 62 in order to prevent the rotation of the link rod 62 with respect to the cantilever 50. The user sits on the seat member 13, grips the positioning members 624 and pulls the same upwardly in order to exercise his arms.

Figure 8:
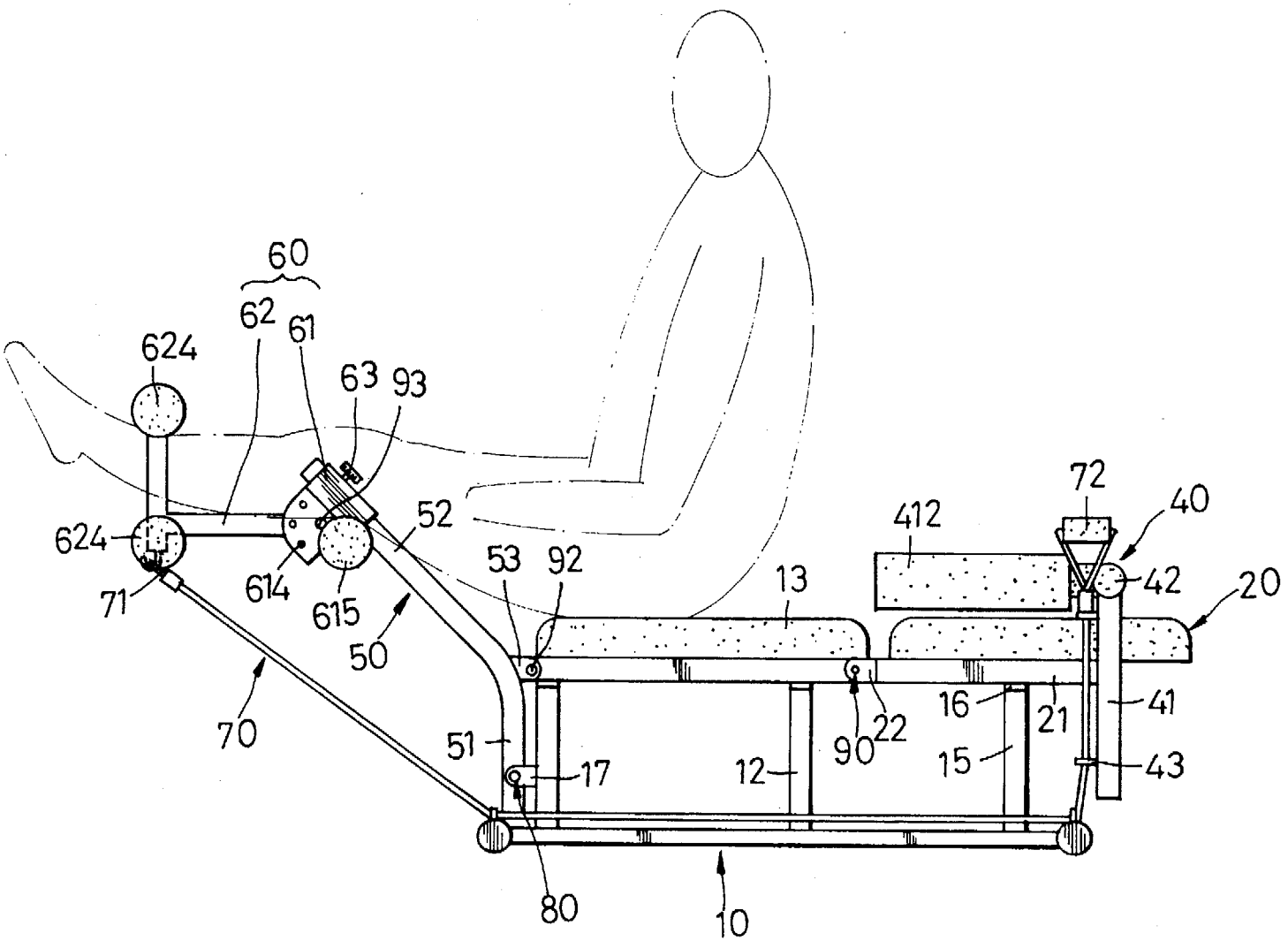
FIG. 8 is a schematic view illustrating how the body exerciser is used to exercise the user's legs.

Referring to FIG. 8, the locking pin 81 is removed from the aligned holes 614 of the sleeve member 61 and the positioning hole 622 of the link rod 62 in order to permit the rotation of the link rod 62 with respect to the cantilever 50 about the pin member 93. The pin member 80 is extended through the pivot seat 17 and the through hole 54 of the cantilever 50 in order to position the cantilever 50 on the base 10. The user sits on the seat member 13 and rotates the footrest unit 60 about the pin member 93 against the spring force of the elastic cords 70 by means of his legs in order to exercise the same. In addition, the locking bolt 63 may engage selectively one of the threaded holes 55 so as to adjust the relative position of the footrest unit 60 and the cantilever 50 in order to suit the user.

It is noted that the body exerciser of the present can be employed to perform different exercises without using the bulky weight unit and the pulley assembly employed in the conventional body exerciser described beforehand. Therefore, the body exerciser has advantageously a simple and compact structure.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangement.

I claim:

1. A body exerciser, comprising:

a base having a seat member mounted to a top portion thereof, and two pairs of front and rear guide rings connected to a bottom portion thereof adjacent to front and rear end portions thereof respectively;

a backrest member connected pivotably to said top portion of said base so that said backrest member can rest on said top portion of said base adjacent to and flush with said seat member;

a U-shaped connecting member having a base portion and two upright arm portions that extend upwardly from said base portion, said base portion being fixed to a bottom face of said backrest member, said arm portions being located on opposite sides of said backrest member;

a pair of handle members, each having a vertical connecting rod with upper and lower ends and a horizontal grip rod which is connected to said upper end of said vertical connecting rod at an end of said grip rod, said upper end of each of said vertical connecting rods being connected pivotably to a distal end of a respective one of said arm portions of said U-shaped connecting member in such a manner that said grip rods are located on opposite sides of said backrest member, said vertical connecting rod of each of said handle members having two positioning rings connected respectively adjacent to said upper and lower ends thereof;

an angled cantilever having a lower section and an upper section which is connected to said lower section to form an angle therebetween, a juncture of said lower and upper sections being connected pivotably to said front end portion of said base, said upper section having a plurality of threaded holes formed along a length thereof;

a footrest unit having a link rod, a sleeve member and a support rod which are connected generally perpendicularly and respectively to two ends of said link rod, said sleeve member being sleeved slidably onto said upper section of said angled cantilever and having a hole and a locking bolt which extends through said hole of said sleeve member in order to engage one of said threaded holes of said cantilever, thereby locking selectively said sleeve member on said cantilever, said sleeve member having two leg-resting members extending perpendicularly from opposite sides thereof, said support rod having upper and lower ends, each of said upper and lower ends of said support rod having a pair of positioning members extending perpendicularly from opposite sides thereof; and two elastic cords, each having a first end connected to said support rod of said footrest unit and a second end connected to a pull member, each of said elastic cords extending through a respective one of said front guide rings, a respective one of rear guide rings, and said positioning rings of a respective one of said vertical connecting rods.

2. The body exerciser as claimed in claim 1, wherein said sleeve member has two spaced, opposed lugs formed at an upper end thereof, said lugs having a number of pairs of angularly spaced, aligned holes and a locking pin extending through one of said pairs of aligned holes, one end of said link rod being connected pivotably between said lugs and having a positioning hole through which said locking pin extends in order to position said link rod relative to said sleeve member at a predetermined angle.

3. The body exerciser as claimed in claim 1, wherein said front end portion of said base has a pivot seat and a pin member extending therethrough, and said lower section of said cantilever has a through hole through which said pin member extends in order to position said cantilever on said base.

* * * * *